US005097947A

United States Patent [19]

Hsu

[11] Patent Number: 5,097,947

[45] Date of Patent: Mar. 24, 1992

[54] PAPER CLIP DISPENSER

[76] Inventor: Nick Hsu, 5 F, 44, Alley 3, Lane 550, Min Chuan East Road, Taipei, Taiwan

[21] Appl. No.: 701,060

[22] Filed: May 16, 1991

[51] Int. Cl.[5] ..... B65D 83/00

[52] U.S. Cl. ..... 206/214; 206/340; 206/818; 221/212

[58] Field of Search ..... 206/338, 340, 214, 224, 206/818; 221/212, 312 C

[56] References Cited

U.S. PATENT DOCUMENTS

| | | | |
|---|---|---|---|
| 3,269,528 | 8/1966 | Leedy | 206/818 X |
| 3,327,688 | 6/1967 | Smith | 206/214 |
| 3,704,777 | 12/1972 | Linnebuhr | 221/212 X |
| 3,704,991 | 12/1972 | Leedy | 221/212 X |
| 3,731,415 | 5/1973 | Shore | 206/818 X |
| 3,750,868 | 8/1973 | Cooper | 206/818 X |
| 4,047,637 | 9/1977 | Grunstad et al. | 206/818 X |
| 4,058,209 | 11/1977 | Schmidt | 206/818 X |
| 4,796,780 | 1/1989 | Huang | 206/818 X |
| 4,928,823 | 5/1990 | Campbell | 206/340 X |
| 4,986,417 | 1/1991 | Hsu | 206/214 |

FOREIGN PATENT DOCUMENTS

| | | | |
|---|---|---|---|
| 338656 | 11/1930 | United Kingdom | 221/212 |

*Primary Examiner*—Paul T. Sewell
*Assistant Examiner*—Jacob K. Ackun, Jr.

[57] ABSTRACT

A paper clip dispenser comprises a container and an upper cover. The container has a hollow interior and a concave bottom. A male snap fitting connector disposed on the upper periphery of the container matches the corresponding female snap fitting connector disposed on the lower periphery of the upper cover. The upper cover has an opening on its upper portion. A seat is disposed on the upper portion of the upper cover. Two passages are formed between the seat and the upper cover. An arc-shaped lid covers the upper opening of the seat. The male connecting portion of the seat matches the corresponding female connecting portion of the lid. A flange extends from the lower periphery of the lid downwardly, and a holder extends from the flange inwardly.

5 Claims, 4 Drawing Sheets 2A-2A 2B-2B

PAPER CLIP DISPENSER

BACKGROUND OF THE PRESENT INVENTION

The present invention relates to a paper clip dispenser and more particularly to an improved paper clip dispenser which is convenient to a user.

There are various kinds of conventional paper clip dispensers. Most of them have a container to receive pins, thumbtacks, and paper clips together. The fingers of the user may be pricked by the pins or thumbtacks, if the user try to take a pin, thumbtack, or paper clip from the container. Referring to FIG. 1, a conventional paper clip dispenser comprises container 10 with an upper cover 11. The upper cover 11 has two holes 111 which are separated by a plate 112. Two magnets 12 are disposed on the inner periphery of the upper cover 11. Since the upper cover 11 has two large holes 111, dust can enter the interior of the container 10 and the pins, thumbtacks, and paper clips 13 within the container will be rusty easily.

OBJECT OF THE PRESENT INVENTION

The main object of the present invention is to provide a paper clip dispenser which is convenient to a user.

Another object of the present invention is to provide a paper clip dispenser which allows a user to approach the dispenser safely.

DESCRIPTION OF THE PREFERRED EMBODIMENT

Figure 1:
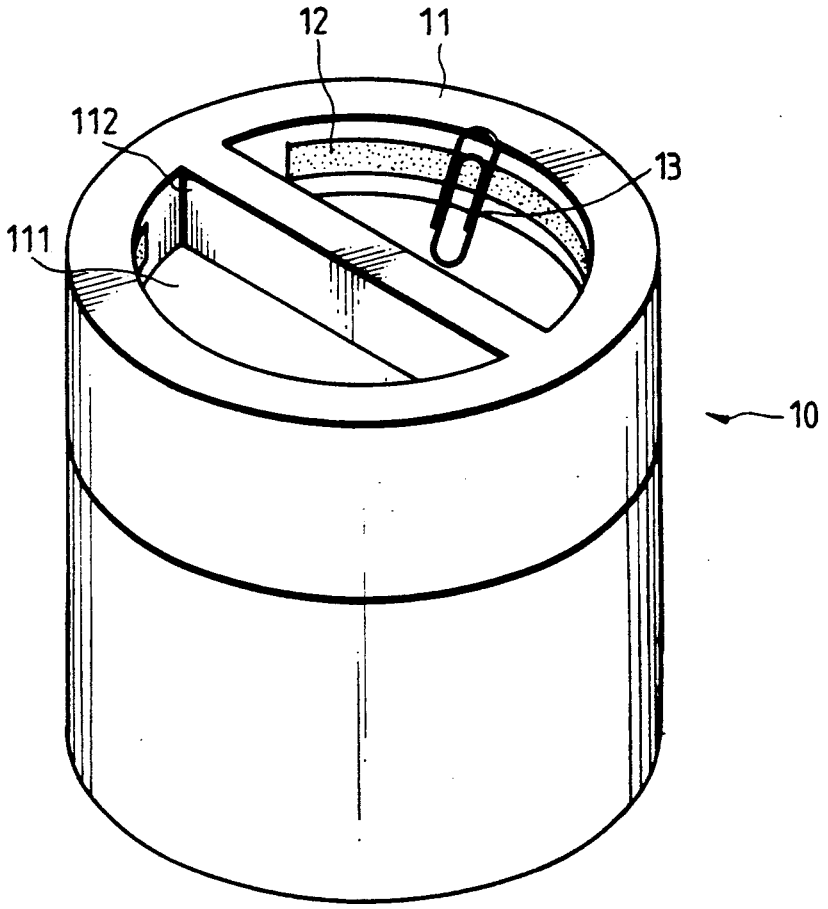
PRIOR ART FIG. 1
FIG. 1 is a perspective assembly view of a conventional paper clip dispenser.
Figure 2:
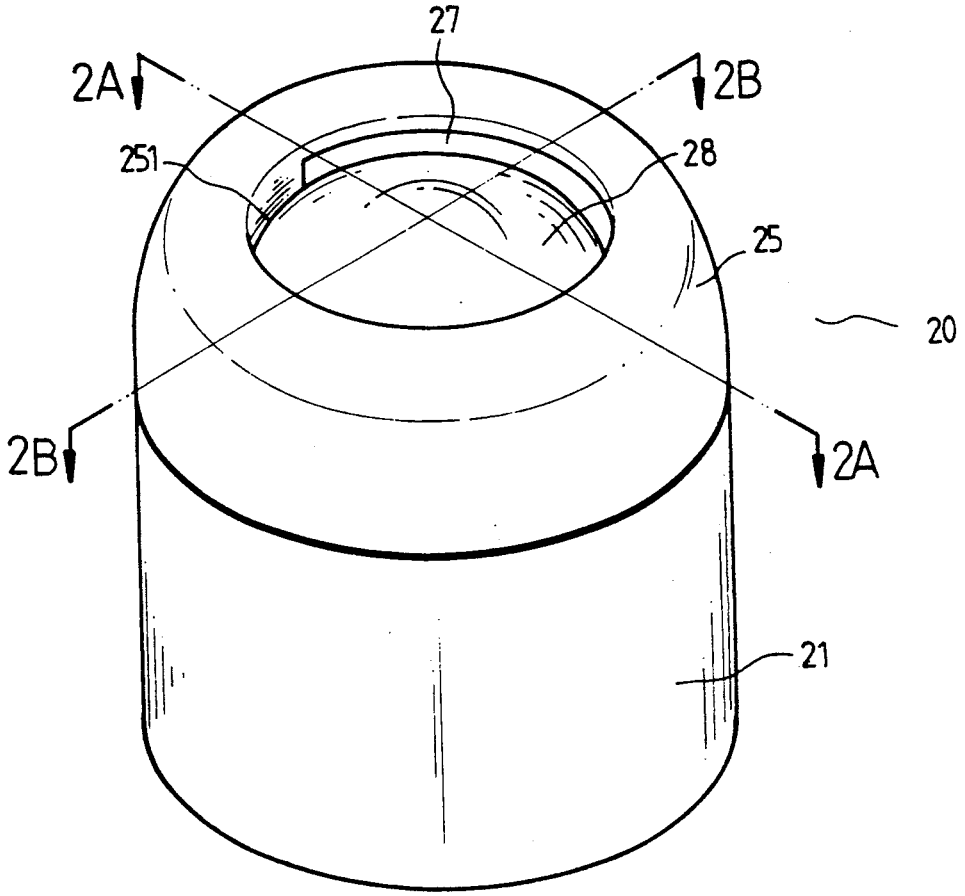
FIG. 2 is a perspective assembly view of a paper clip dispenser of a preferred embodiment in accordance with the present invention.
Figure 3:
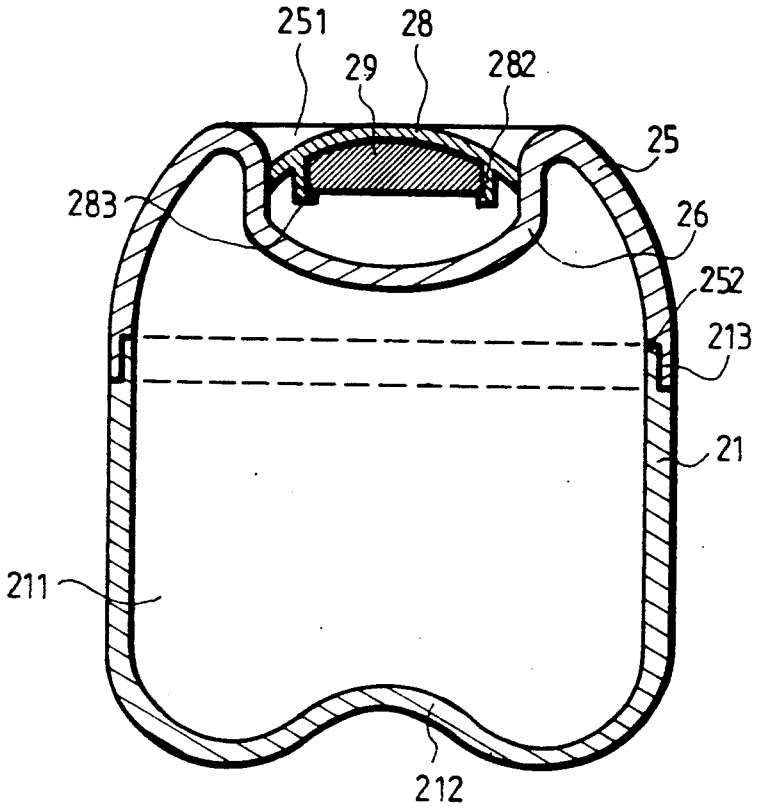
FIG. 3 is a cross-sectional view taken along line 2A—2A in FIG. 2.
Figure 4:
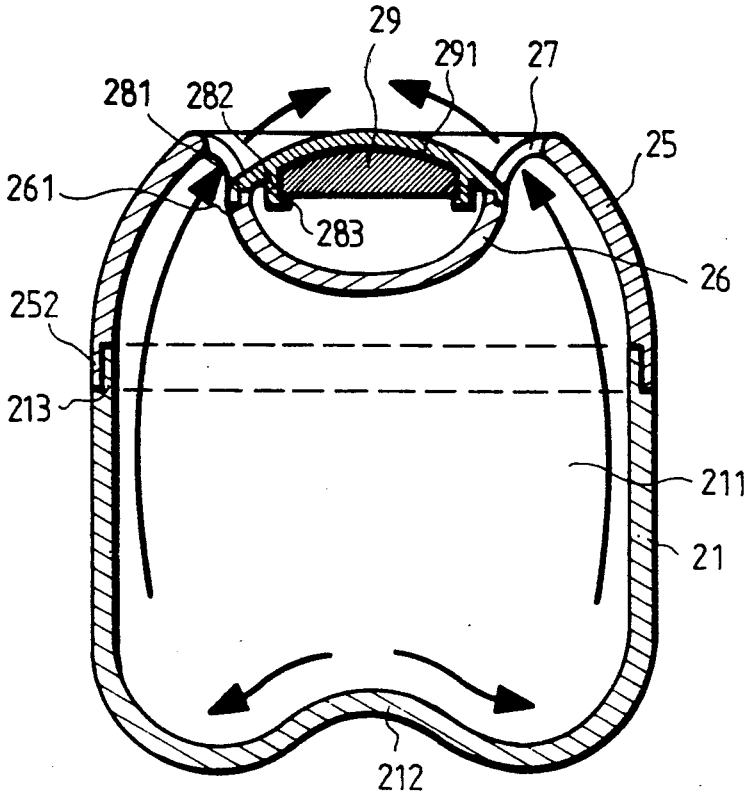
FIG. 4 is a cross-sectional view taken along line 2B—2B in FIG. 2.

Referring to FIGS. 2 to 4, a paper clip dispenser 20 comprises a container 21 and an upper cover 25. The container 21 has a hollow interior 211 and a concave bottom 212. Thus paper clips can be received by the container 21, and paper clips are piled up within the lower portion of the hollow interior 211. A male snap fitting connector 213 disposed on the upper periphery of the container 21 can match the corresponding female snap fitting connector 252 disposed on the lower periphery of the upper cover 25. The upper cover 25 has an opening 251 on its upper portion. A seat 26 which is disposed on the upper portion of the upper cover 25 is below the opening 251. Two passages 27 which are formed between the seat 26 and the upper cover 25 are the passage for paper clips. An arc-shaped lid 28 covers the upper opening of the seat 26. The male connecting portion 261 of the sear 26 matches the corresponding female connecting portion 281 of the lid 28. A flange 282 extends from the lower periphery of the lid 28 downwardly, and a magnet holder 283 extends from the flange 282 inwardly. Thus a magnet 29 is disposed under the lid 28 and supported by the magnet holder 283. The upper surface 291 of the magnet 29 is convex so that the magnet 29 has a large surface. An adhesive can be applied to the upper surface 291 of the magnet 29.

The upper cover 25 can be opened or closed. After the upper cover 25 is opened, paper clips can be placed in the hollow interior 211. The arc-shaped lid 28 is very thin so that the paper clips can be adhered to the lid 28 while the user shakes the paper clip dispenser 20. When the user shakes the dispenser 20, the paper clips which pass through the passages 27 will be attracted by the magnet 29 to the upper surface of the lid 28. Since the passages 27 are very small, paper scraps will not enter the interior 211 of the dispenser 20. The upper portion of the upper cover 25 is higher than the seat 26, so the paper clips are easily attracted by the magnets 29 and adhered to the upper surface of the arc-shaped lid 28. Therefore, the paper clips will not be fallen off.

I claim:

1. A paper clip dispenser comprising:

a container having a bottom, said bottom extending concavely into an interior portion of said container;

a removable cover covering a top of said container, said cover having an upper opening;

said upper cover disposed on a top of said container;

a seat formed in and depending from an upper portion of said cover such that said seat is disposed below said cover upper opening and supports an arc shaped lid within said cover upper opening, said lid covering said seat;

a magnet fixed in position abutting a lower surface of said lid;

at least one passage formed between said seat and said cover upper portion for dispensing of paper clips from the interior of the container.

2. A paper clip dispenser as claimed in claim 1, wherein two passages are formed between said seat and said cover upper portion.

3. A paper clip dispenser as claimed in claim 1, wherein a flange extends from a lower periphery of said lid downwardly and a holder extends from said flange inwardly to hold said magnet in position.

4. A paper clip dispenser as claimed in claim 1, wherein a male connecting portion disposed on an upper portion of said seat and a corresponding female connecting portion disposed on a lower portion of said lid cooperate together to support said lid on said seat.

5. A paper clip dispenser as claimed in claim 1, wherein a male snap fitting connector disposed on an upper portion of said container and a corresponding female snap fitting connector disposed on a lower portion of said cover cooperate together to attach said cover to said container.

* * * * *